US005802677A

United States Patent [19]

Dorman et al.

[11] Patent Number: 5,802,677

[45] Date of Patent: Sep. 8, 1998

[54] BAG CLOSURE CLIP

[75] Inventors: John G. Dorman; Gordon Isenga, both of Holland; Russell O. Blanchard, Zeeland, all of Mich.

[73] Assignee: Lilly Industries (USA), Inc., Indianapolis, Ind.

[21] Appl. No.: 744,358

[22] Filed: Nov. 6, 1996

[51] Int. Cl.[6] ..... A44B 21/00; A47G 25/48

[52] U.S. Cl. ..... 24/30.5 R; 24/30.5 P; 24/511; 24/501

[58] Field of Search ..... 24/500, 503, 508, 24/511, 557, 545, 530, 565, 489, 499, 67.9, 67.3, 30.5 R

[56] References Cited

U.S. PATENT DOCUMENTS

| | | | |
|---|---|---|---|
| D. 296,729 | 7/1988 | Blanchard . | |
| D. 303,216 | 9/1989 | Hoffman et al. . | |
| 3,096,551 | 7/1963 | Shoeberg | 24/501 X |
| 3,456,262 | 7/1969 | Coon | 24/511 X |
| 4,145,793 | 3/1979 | Berlet | 24/511 X |
| 4,356,600 | 11/1982 | Welch . | |
| 4,394,791 | 7/1983 | Groth . | |
| 4,660,750 | 4/1987 | Blanchard . | |
| 4,669,152 | 6/1987 | Alexander | 24/30.5 R |
| 4,701,893 | 10/1987 | Warmath | 24/511 |
| 5,318,292 | 6/1994 | De Marco | 24/511 X |
| 5,402,558 | 4/1995 | Satapa | 24/511 |
| 5,457,858 | 10/1995 | Lin | 24/511 |
| 5,621,955 | 4/1997 | Schmid et al. | 24/511 |

OTHER PUBLICATIONS

Photographs (four) of Bag Clip closure clip (assembled and disassembled views).

*Primary Examiner*—Peter M. Cuomo
*Assistant Examiner*—Robert J. Sandy
*Attorney, Agent, or Firm*—Warner Norcross & Judd LLP

[57] ABSTRACT

A bag closure clip including a pair of opposing T-shaped clip members held in pivotal engagement by a U-shaped metal spring. Each clip member includes a jaw, a handle, and a fulcrum. As the handles are squeezed toward each other, the jaws open to allow a bag, such as for snack food or cereal, to be inserted between the jaws. When the handles are released, the spring forces the jaws towards each other to grip the bag and hold it closed. The U-shaped spring is fitted over the fulcrum and is confined to the space between the clip members so that the outwardly facing surfaces of the clip members are substantially uninterrupted.

18 Claims, 7 Drawing Sheets

BAG CLOSURE CLIP

BACKGROUND OF THE INVENTION

The present invention relates to bag closure clips, and more particularly to spring-activated closure clips of the type widely used for holding closed the rolled top of a bag of potato chips, breakfast cereal, or the like.

Spring-activated closure clips have gained widespread acceptance and popularity among consumers to hold closed the rolled tops of opened bags, such as snack-food bags and breakfast cereal bags. When such a bag is opened, it is not unusual for the contents not be consumed all at once. Consequently, it is desirable to close the bag by rolling or folding the top down on itself and clipping the rolled top with a bag clip.

One particularly effective clip is that sold under the CHIP CLIP trademark by Guardsman Products, Inc. (the assignee of the present application). Such clips are illustrated and disclosed in U.S. Pat. No. 4,394,791 to Groth issued Jul. 26, 1983 and entitled "Closure Clamp for Food Bags"; U.S. Pat. No. 4,356,600 to Welch issued Nov. 2, 1982 entitled "Bag Closure Device"; and U.S. Pat. No. D303,216 to Hoffman et al issued Sept. 5, 1989 entitled "Closure Clip for Bag of Comestibles or the Like." The closure clips disclosed in these references include a pair of opposed clip members and a torsion spring to urge the opposing clip members toward one another.

As effective as these clips have proven, the torsion springs are not without disadvantages. First, the torsion spring extends outside of the closure clip and is thus externally visible. This causes an unappealing cluttered appearance and reduces the available surface area of the closure clip for graphics. Further, the torsion spring terminates in exposed wire ends that can snag or cut. Also, the torsion spring can cause the clip members to misalign relative to each other after opening the clip, and cause an uneven distribution of pressure across the gripping surface when the clip is closed. Further, the manufacture of closure clips with torsion springs is not easily automated. Finally, the torsion spring is seated in external grooves in the clip members; these grooves can cause areas of stress concentration and weakness in the clip.

Another closure clip is sold under the trademark BAG CLIP and manufactured in China for Bradshaw International, Inc., Etco Housewares, Inc., and G & S Metal Products Company. This closure clip includes a pair of opposed clip members and a plastic clip spring, which is visible through a window in the external surface of each clip member, to urge the opposing clip members toward one another. However, the BAG CLIP design has several disadvantages. The window weakens the clip member, disrupts the external appearance of the closure clip, and reduces the external area available for graphics. Further, the plastic clip spring can fatigue and crack after an unacceptably low number of uses. Also, the plastic clip spring bears on the clip members close to the clip fulcrum, thereby providing a less uniform distribution of pressure across the jaw-gripping surface. Finally, the plastic clip spring action weakens when operating the clip over an extended period of time.

SUMMARY OF THE INVENTION

The aforementioned problems are overcome in the present invention wherein a bag closure clip incorporates an internal clip spring. More specifically, the bag closure clip includes a pair of opposing T-shaped clip members, each having a jaw as the "cross" of the T-shape and a handle extending from the jaw to complete the T-shape. The handles include a fulcrum providing a "pinch clip" operation. The clip members are held together by the metal clip spring fitted over the fulcrum and located within the clip interior. The clip spring urges the jaws together to a closed position touching one another. Pinching the handles opens the jaws so that the open jaws can be fitted over or removed from a rolled bag top. Releasing the handles allows the jaws to close.

The packaging closure clip of the present invention has a smooth, clean external appearance without an external torsion spring component to break the visual lines of the packaging closure clip. The packaging closure clip provides more area for graphics, and eliminates the potential for snags or cuts from external torsion spring endpoints. Further, the packaging closure clip of the present invention eliminates external slots, grooves, or windows that can weaken the clip members. Also, the metal closure clip maintains a "fresh-feeling" spring action over a long life. Lastly, the closure clip of the present invention permits easier automatic assembly, thus reducing manufacturing costs.

In one embodiment of the invention, a metal closure clip extends into the jaw area of the closure clip, providing a more uniform distribution of pressure across the width of the jaw, and thus a more even grip.

These and other objects, advantages, and features of the invention will be more readily understood and appreciated by reference to the detailed description of the preferred embodiment and the drawings.

DETAILED DESCRIPTION OF THE PREFERRED EMBODIMENT

I. Summary of the Structure and Operation

Figure 1:
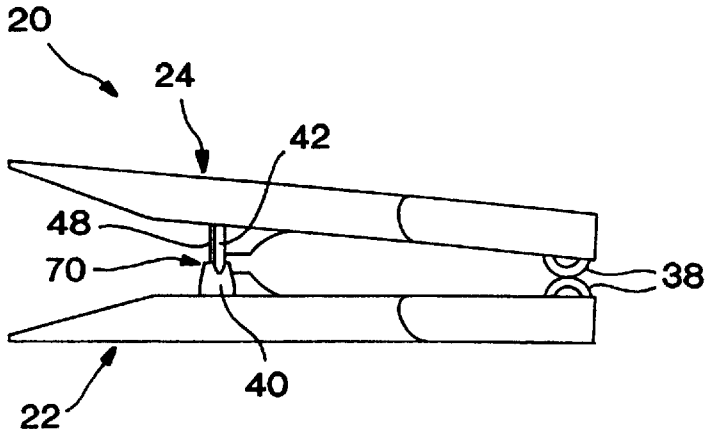
FIG. 1 is a view of the bag closure clip of the present invention, shown in the closed position.
Figure 1A:
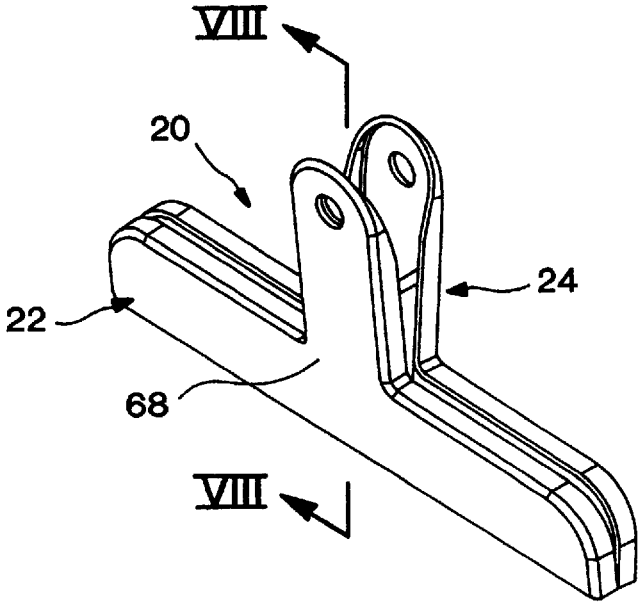
FIG. 1*a* perspective view of the bag closure clip.
Figure 8:
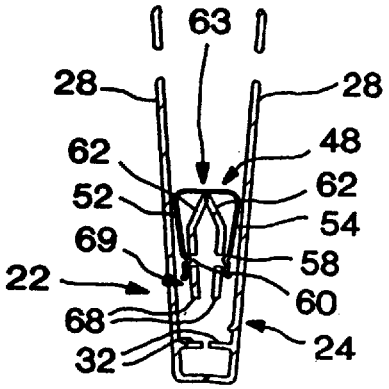
FIG. 8 is a sectional view taken along line VIII—VIII of FIG. 1*a;*
Figure 8A:
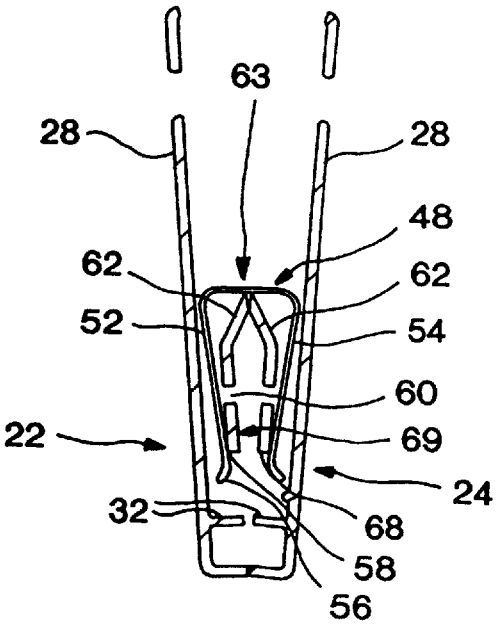
FIG. 8*a* is a sectional view taken along line VII—VII of FIG. 1*a* showing an alternative placement of the clip spring.
Figures 13, 14, 15, 16:
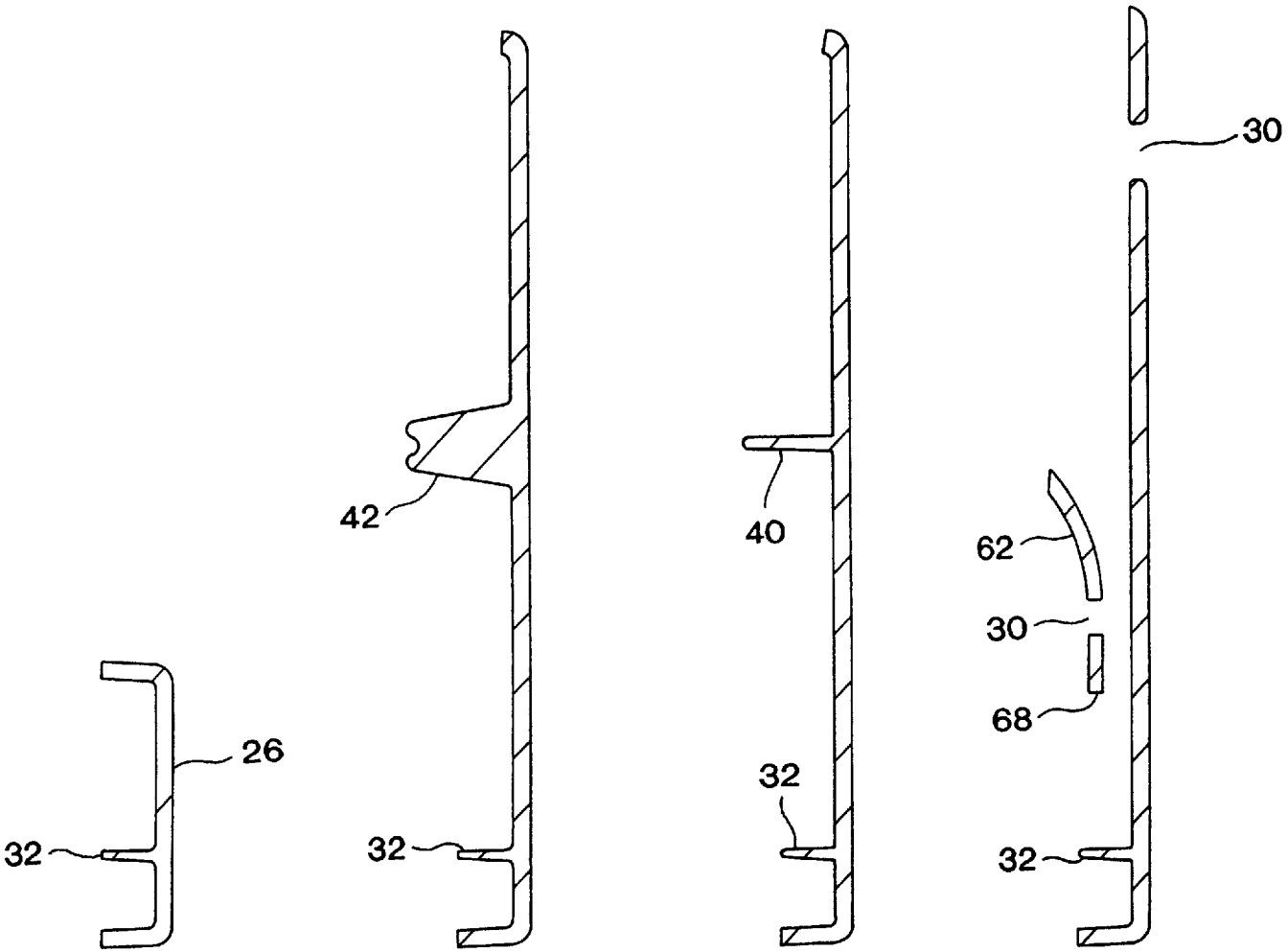
FIG. 13 is the sectional view taken along line XIII—XIII of FIG. 5.
FIG. 14 is the sectional view taken along line XIV—XIV of FIG. 5.
FIG. 15 is the sectional view taken along line XV—XV of FIG. 5.
FIG. 16 is the sectional view taken along line XVI—XVI of FIG. 5.

Referring to the drawings, FIG. 1 shows the bag closure clip 20 of the present invention. As shown in FIGS. 1–4, the closure clip 20 has two opposing, spring-loaded clip members 22 and 24, each including a jaw 26 and a handle 28. As shown in FIGS. 8 and 8*a*, a metal clip spring 48 is mounted on the clip members to bias or urge the jaws together and thus close the jaws. The clip spring 48 is contained within the interior of the clip 20 to eliminate the foregoing noted drawbacks of a torsion spring. The clip 20 is "opened" by pinching the handles 28 together. The clip 20 "closes" under the force of the clip spring 48 when the handles are released. The clip 20 is therefore easily installed on, and removed from, the rolled or folded top of a bag.

II. Detail of the Structure

A. Clip Members

Figure 4:
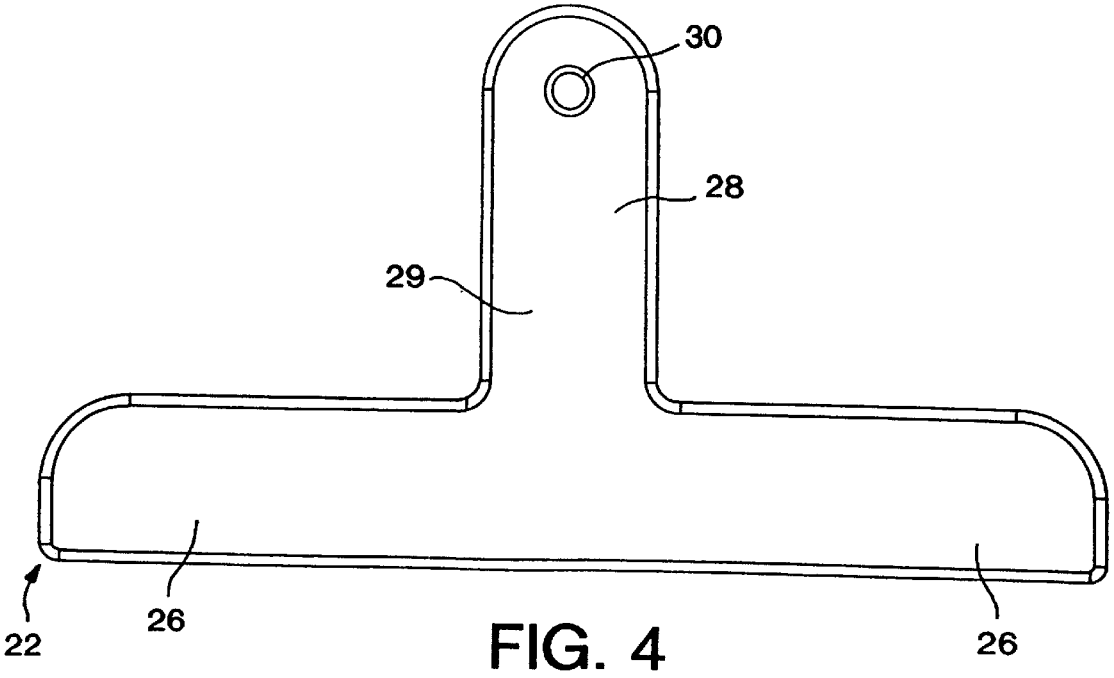
FIG. 4 is a front view of the T-shaped clip member.
Figure 5:
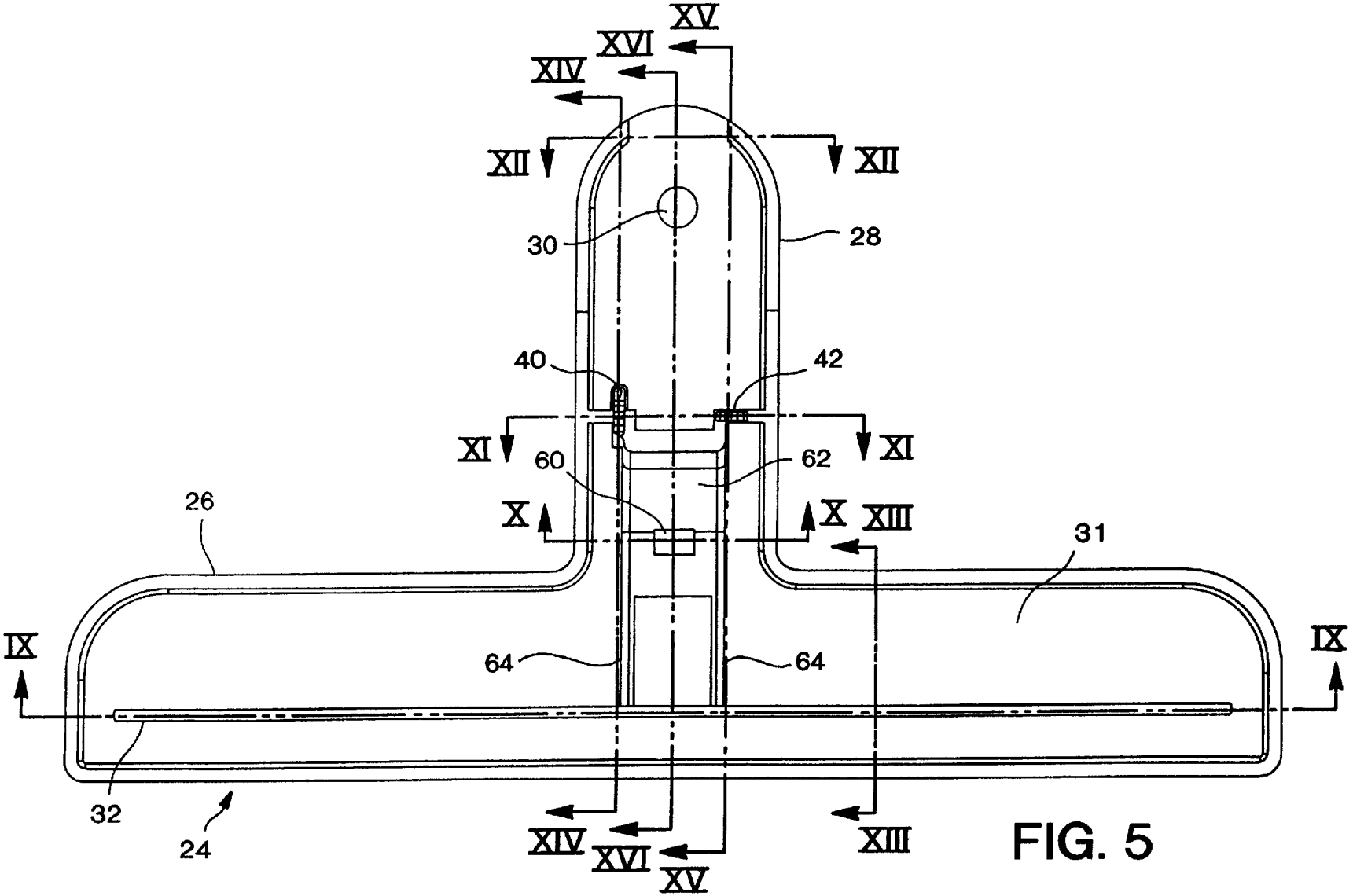
FIG. 5 is a back view of the T-shaped clip member.
Figure 6:
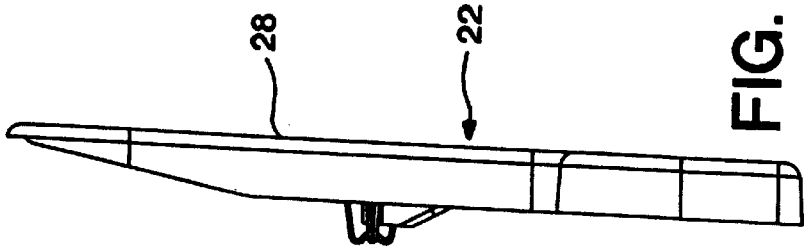
FIG. 6 is a side view of the T-shaped clip member.
Figure 7:
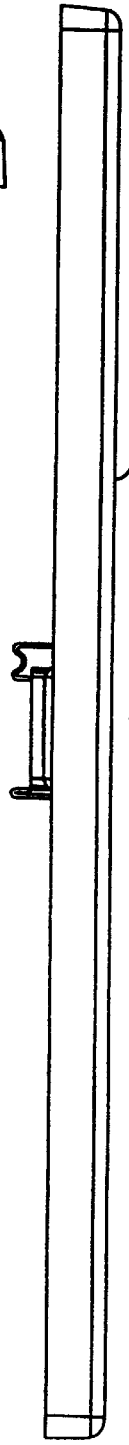
FIG. 7 is a bottom view of the T-shaped clip member.
Figure 9:
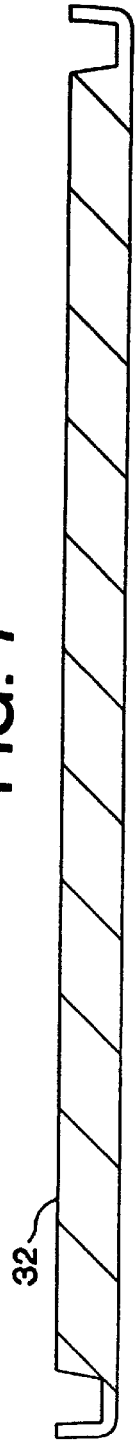
FIG. 9 is a sectional view taken along line IX—IX of FIG. 5.
Figure 10:
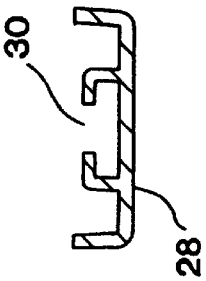
FIG. 10 is a sectional view taken along line X—X of FIG. 5.
Figure 11:
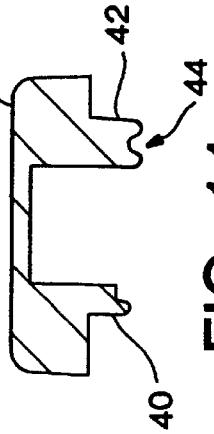
FIG. 11 is the sectional view taken along line XI—XI of FIG. 5.
Figure 12:
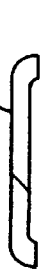
FIG. 12 is the sectional view taken along line XII—XII of FIG. 5.

Turning to FIGS. 4 and 5, clip members 22 and 24 have a T-shape, with a jaws 26 forming the "cross" of the T-shape and handles 28 extending from the jaws 26 to complete the T-shape. As is further discussed below, clip members 22 and 24 are essentially identical. As shown in FIG. 4, clip member 22 has an exterior or front surface 29 extending along the smooth, substantially uninterrupted exterior surface of jaw 26 and handle 28. In this context, "substantially uninterrupted" means that the front surface 29 lacks slots, grooves, or windows associated with a closing mechanism such as a spring, but may include a hole or other means for hanging the closure clip, as discussed below. As shown in FIG. 5, clip member 24 has an internal or back surface 31 extending along the interior surface of jaw 26 and handle 28. The internal surface 31 is not "smooth" or uninterrupted because of the various interior features of the clip member included or contained in the interior of the closure clip, as further discussed below.

The length of jaw 26 will vary depending upon the type and size of the package to be sealed by the closure clip. A jaw having approximately a 6 inch length is currently preferred for most standard size snack-food bags.

The handle 28 defines a hole 30. The hole 30 provides an easy means for hanging the closure clip on a hook (not shown), even while the bag closure clip is gripping a package.

B. Interior Features of the Clip Member

1. Fulcrum

Figure 3:
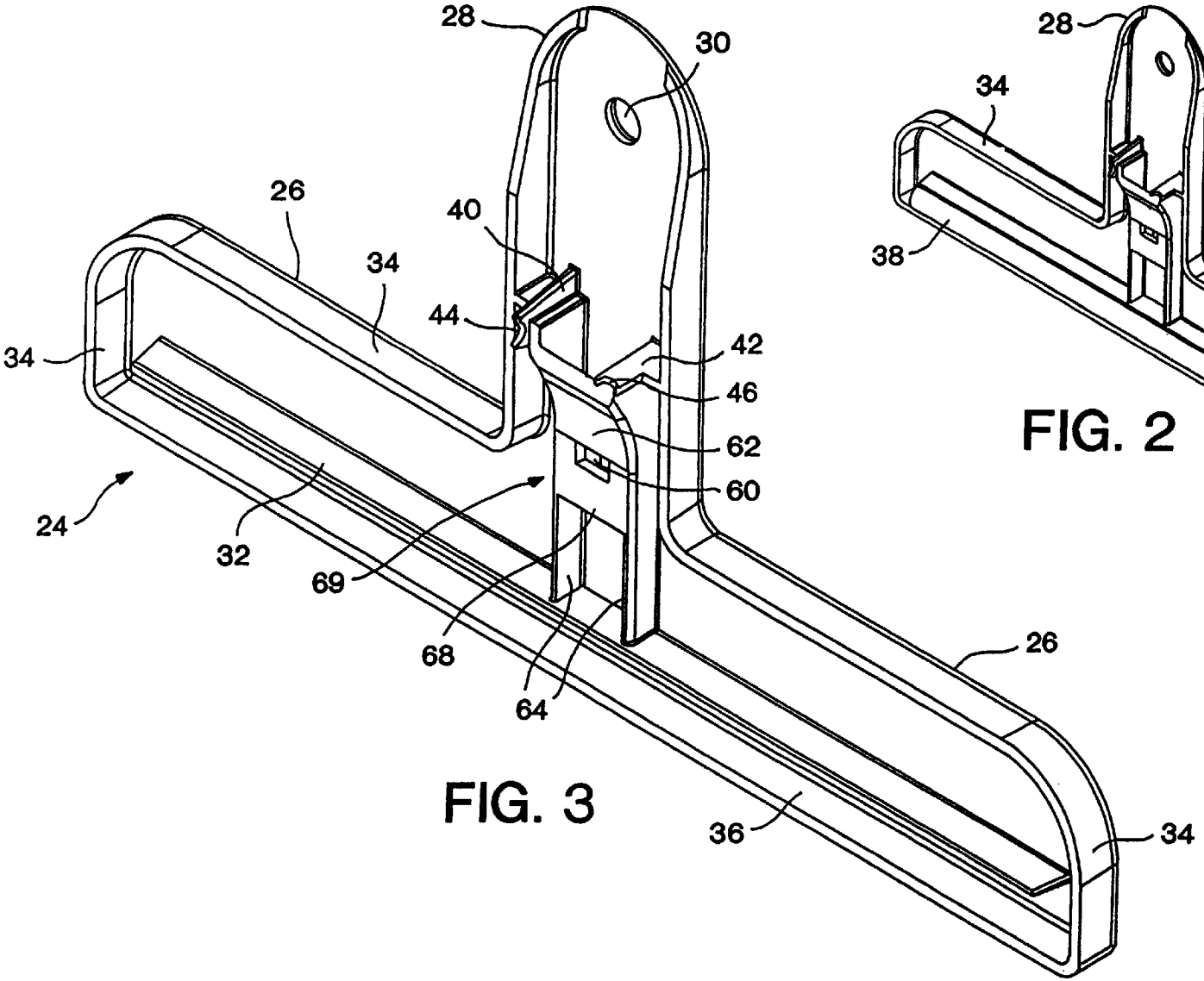
FIG. 3 is a perspective view of the T-shaped clip member without the gripping means.

Turning to FIG. 3, risers 40 and 42 extend from handle 28 to terminate in slots 44 and 46, respectively. The slot 44 of riser 40 has a ninety degree orientation relative to the slot 46 of riser 42. Because of this orientation, slot 44 of riser 40 of clip member 22 engages and fits within the slot 46 of riser 42 of clip member 24 to provide a hinge or fulcrum 70 (FIG. 1). Similarly, slot 46 of riser 42 of clip member 22 engages and fits within slot 44 of riser 40 of clip member 24 to provide the hinge or fulcrum 70.

2. Stiffening Ribs and Connecting Arch

Continuing with FIG. 3, stiffening ribs 64 extend from handle 28. A connecting arch 62 connects stiffening ribs 64, and is positioned between risers 40 and 42. The connecting arch 62 defines a stop window 60 and terminates in a lower edge 68 closest to the jaw 26. As shown in FIG. 8, the connecting arches 62 of opposing clip members 22 and 24 form arch 63.

3. Jaw Channel

Again turning to FIG. 3, raised channel lip 32 extends from the jaw 26 substantially along its entire length. "Substantially" in this context means that the channel lip extends long enough to provide a friction fit for the flexible tubing 38, as discussed below. Further, the jaw 26 has border lip 34 extending around its exterior. The space between channel lip 32 and border lip 34 defines the channel 36.

4. Gripping Means

Figure 2:
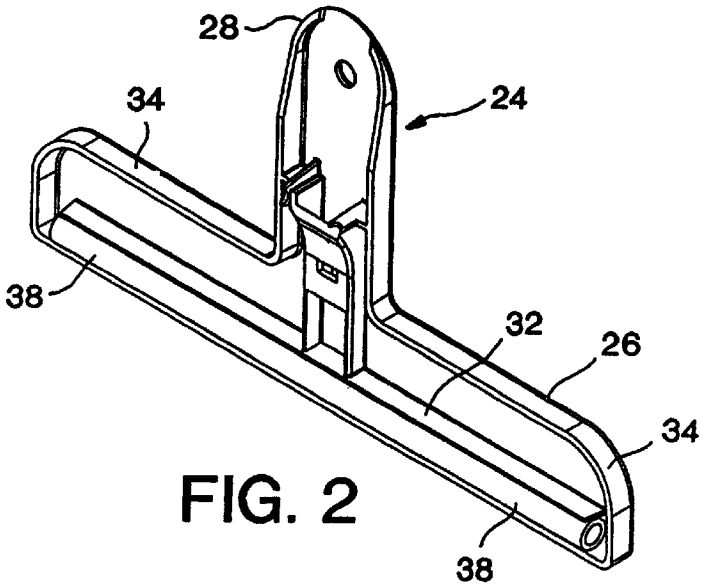
FIG. 2 is a perspective view of one T-shaped clip member including the gripping means.

Turning to FIG. 2, flexible tubing 38 is positioned within the channel 36 and extends beyond or protrudes outside of channel 36. The flexible tubing 38 positioned in channels 36 of each clip member provides a gripping means by grippingly engaging each another when bag closure clip 20 is in the closed position (FIG. 1). Preferably, flexible tubing 38 is formed of polyethylene tubing having a somewhat tacky surface. Flexible tubing 38 is held within channel 36 by a friction fit. Flexible tubing 38 extends substantially along the length of jaw 26 to provide gripping means along most of the length of jaw 26.

C. Clip Spring

Figure 17:
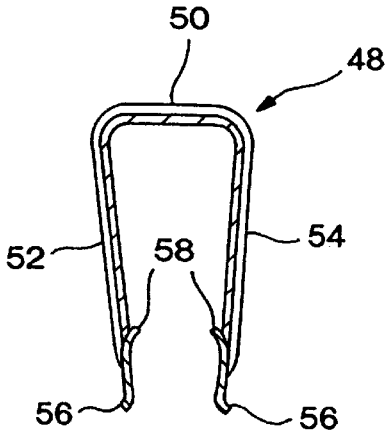
FIG. 17 is a side view of the clip spring.
Figure 18:
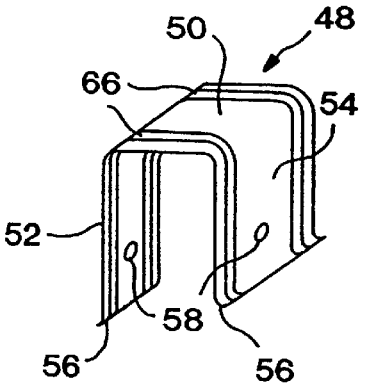
FIG. 18 is a perspective view of the clip spring.

Turning to FIG. 8, the bag closure clip contains a metal clip spring 48. "Clip spring" as used herein means a U-shaped spring device used in fabricating garment hangers such as that described in U.S. Pat. No. 4,660,750 to Blanchard issued Apr. 28, 1987 and entitled "Garment Hanger with Improved Wire Support," incorporated herein by reference. As shown in more detail in FIGS. 17 and 18, clip spring 48 has connecting web 50 and side webs 52 and 54. Clip spring 48 also includes a pair of spring ribs 66 to provide stiffness. The side webs 52 and 54 of the spring clip terminate in outward turns 56. The side webs 52 and 54 also include barbs 58.

Continuing with FIG. 8, side webs 52 and 54 of clip spring 48 are positioned between the connecting arches 62 and handles 28 so that the U-shaped clip spring 48 encloses or surrounds the arch 63. Further, the side webs 52 and 54 engage the connecting arches 62 and are positioned between the stiffening ribs 64 of the clip members (FIG. 3). Thus, the connecting arches 62 provide a spring support means 69. The barbs 58 engage stop windows 60 to hold clip spring 48 in position so that the connecting web 50 of clip spring 48 is positioned beyond the fulcrum 70 formed by risers 40 and 42 (FIG. 1). "Beyond" in this context means that connecting web 50 of spring clip 48 is positioned so that a bag inserted between clip members 22 and 24 will engage fulcrum 70 formed by risers 40 and 42 before engaging the clip spring 48.

FIG. 8*a* shows an alternative embodiment of the present invention, in which the spring support means 69 extends within the region of the jaws 26. Side webs 52 and 54 extend beyond the lower edge 68 of the connecting arch 62, so that the barbs 58 also extend below the lower edge 68. Outward turns 56 may engage channel lips 32 or some other suitable stop. In this embodiment, the side webs 52 and 54, and thus clip spring 48, extend within the jaws 26 (FIG. 3).

Turning to FIGS. 1, 8, and 8*a*, the clip spring 48 provides the spring tension that holds the risers 40 and 42 of clip members 22 and 24 in the hinged or pivotal engagement that forms the fulcrum 70. Further, the clip spring is biased to hold the closure clip in the closed position so that the flexible tubings 38 of each clip member grippingly engage each other or the packaging (not shown) that is positioned between them. Further, in the embodiment in which the clip spring webs 52 and 54 extend to within the jaws (FIG. 8*a*), the clip spring provides a more uniform distribution pressure across the flexible tubing 38.

III. Assembly and Operation

A. Assembly

To assemble the closure clip 20, flexible tubings 38 are inserted in channels 36 of clip members 22 and 24. The clip members are placed in opposing engagement so that risers 22 and 24 of clip member 22 engage risers 24 and 22 of clip member 24, respectively. Clip spring 48 is pushed down the connecting arches 62 so that arch 63 is enclosed or surrounded by the U-shaped clip spring. As the clip spring 48 is pushed down, the side webs 52 and 54 are spread apart by the connecting arches 62 until barbs 58 engage or extend into stop windows 60 of each of the clip members 22 and 24 (FIG. 8) or extend beyond lower edge 68 to within the jaws (FIG. 8*a*). The outward turns 56 of clip spring 48 facilitate this installation.

Preferably, clip members 22 and 24 are essentially identical so that they can be formed as plastic pieces from the same mold. Also preferably, the molding process is injection molding using styrene plastic. Many variations in molding techniques and plastics can be used, as is known in the art.

B. Operation

To use the bag closure clip 20, handles 28 of each clip member are squeezed toward each other to disengage or "open" the jaws 26 of the clip members and disengage the flexible tubings 38. An open bag (not shown) is inserted between the jaws and gripping means. Upon releasing handles 28, the clip spring 48 forces the jaws 26 toward each other to "close" and causes flexible tubing 38 to engage the packaging to seal it. The relatively high coefficient of friction of the tubing 38 assists in gripping the bag and retaining the clip on the bag.

The above description is that of a preferred embodiment of the invention. Various alterations and changes can be made without departing from the spirit and broader aspects of the invention as defined in the claims, which are to be interpreted in accordance with the principles of patent law, including the doctrine of equivalents.

The embodiments of the invention in which an exclusive property or privilege is claimed are defined as follows:

1. A bag closure clip comprising:

first and second essentially identical opposing T-shaped clip members, each clip member including a jaw, a handle extending from the jaw, and a substantially uninterrupted front surface extending along the jaw and handle;

each handle having first and second risers extending from the handle to terminate in slots, the slot of the first riser having a 90 degree orientation relative to the slot of the second riser, the first and second risers of the first clip member hingedly engaging the second and first risers of the second clip member, respectively, to form a pair of fulcrums; and a U-shaped metal clip spring having a pair of side webs connected by a central web, each of the side webs attaching to a corresponding clip member to hold the first and second risers of the opposing clip members in pivotal engagement, the clip spring being biased to close the jaws, the central web of the clip spring being positioned beyond the pair of fulcrums, and the side webs extending within the jaws.

2. A bag closure clip comprising:

a pair of clip members each including a jaw and a handle, each of said clip members further including a front surface extending along said jaw and said handle;

fulcrum means for hingedly supporting said clip members relative one another with said jaws facing one another, with said handles facing one another, and with said front surfaces facing outwardly away from one another to define the lateral extent of the clip;

spring support means on each of said clip members for supporting a spring, said spring support means being located toward said jaws from said fulcrum means; and a U-shaped spring fitted over said fulcrum means and bearing against both of said spring support means on each of said clip members to urge said jaws toward one another, said fulcrum means, said spring support means, and said spring being located between said front surfaces of said clip members, wherein said front surfaces are substantially uninterrupted.

3. The bag closure clip of claim 2 wherein said spring and said spring support means extend within said jaws.

4. The bag closure clip of claim 2 wherein the jaws define a channel extending substantially along the length of the jaws, and further comprising flexible tubing positioned in the channel and protruding outside the channel.

5. A bag closure clip comprising:

a pair of clip members each including a jaw and a handle, each of said clip members further including a front surface extending along said jaw and said handle;

fulcrum means for hingedly supporting said clip members relative one another with said jaws facing one another, with said handles facing one another, and with said front surfaces facing outwardly away from one another to define the lateral extent of the clip, wherein the fulcrum means comprises a riser extending from each handle to terminate in a slot, the slot of the riser of one clip member hingedly engaging the slot of the riser of the other clip member;

spring support means on each of said clip members for supporting a spring, said spring support means being located toward said jaws from said fulcrum means; and a U-shaped spring fitted over said fulcrum means and bearing against both of said spring support means on each of said clip members to urge said jaws toward one another, said fulcrum means, said spring support means, and said spring being located between said front surfaces of said clip members, whereby said front surfaces are substantially uninterrupted.

6. A bag closure clip comprising:

a pair of clip members each including a jaw and a handle, each of said clip members further including a front surface extending along said jaw and said handle, wherein the pair of clip members are essentially identical, whereby the pair of clip members can be formed from one mold;

fulcrum means for hingedly supporting said clip members relative one another with said jaws facing one another, with said handles facing one another and with said front surfaces facing outwardly away from one another to define the lateral extent of the clip, wherein the fulcrum means comprises first and second risers extending from each handle to terminate in slots, the slot of the first riser having a 90 degree orientation relative to the slot of the second riser, the first and second risers of one clip member hingedly engaging the second and first risers of the other clip member, respectively;

spring support means on each of said clip members for supporting a spring, said spring support means being located toward said jaws from said fulcrum means; and a U-shaped spring fitted over said fulcrum means and bearing against both of said spring support means on each of said clip members to urge said jaws toward one another, said fulcrum means, said spring support means, and said spring being located between said front surfaces of said clip members, whereby said front surfaces are substantially uninterrupted.

7. The bag closure clip of claim 2 wherein the U-shaped spring includes a pair of side webs connected by a central web, each of the side webs attaching to one of the clip members, the central web positioned beyond the fulcrum means, whereby a package can be inserted between the open jaws without engaging the spring.

8. The bag closure clip of claim 7 wherein the side webs extend within the jaws.

9. The bag closure clip of claim 2 having not more than one U-shaped spring.

10. An improved bag closure clip including a pair of hinged clip members, each of said clip members having a jaw and a handle, said clip members including a fulcrum about which said clip members hinge, and a spring mechanism for urging the jaws toward one another, wherein the improvement comprises:

said spring mechanism comprising:

a spring support element on each of said clip members, said spring support elements located between said fulcrum and said jaws and extending within said jaws; and a U-shaped spring extending over said fulcrum and within said jaws and engaging both of said spring support elements; and said clip members including a substantially uninterrupted exterior surface extending along each of said handles and jaws said exterior surfaces of said clip members facing away from one another, said spring positioned between said external surfaces.

11. The improved bag closure clip of claim 10 wherein the improvement further comprises not more than one said U-shaped spring.

12. A bag closure clip comprising:

a pair of opposing T-shaped clip members, each clip member having a jaw and a handle extending from the jaw, wherein each clip member includes a substantially uninterrupted external surface extending along the jaw and handle,said external surfaces of said clip members facing away from one another;

fulcrum means contained in the clip members; and a clip spring attached to the clip members and extending within the jaws of the clip members to hold the fulcrum means in pivotal engagement, the clip spring being biased to close the jaws when no force is applied to the handles, said clip spring located between said external surfaces.

13. The bag closure clip of claim 12 having not more than one clip spring.

14. The bag closure clip of claim 12 wherein the fulcrum means comprises a riser extending from each handle to terminate in a slot, the slot of the riser of one clip member hingedly engaging the slot of the riser of the other clip member.

15. A bag closure clip comprising:

a pair of opposing T-shaped clip members, each clip member having a jaw and a handle extending from the jaw, wherein the pair of clip members are essentially identical, whereby the pair of clip members can be formed from one mold;

fulcrum means contained in the clip members, wherein the fulcrum means comprises first and second risers extending from each handle to terminate in slots, the slot of the first riser having a 90 degree orientation relative to the slot of the second riser, the first and second risers of one clip member pivotally engaging the second and first risers of the other clip member, respectively; and a clip spring attached to the clip members and extending within the jaws of the clip members to hold the fulcrum means in pivotal engagement, the clip spring being biased to close the jaws when no force is applied to the handles.

16. The bag closure clip of claim 12 wherein the clip spring is generally U-shaped having a pair of side webs connected by a central web, each of the side webs attaching to one of the clip members, the central web positioned beyond the fulcrum means, whereby a package can be inserted between the open jaws without engaging the clip spring.

17. The bag closure clip of claim 16 wherein the side webs extend within the jaws.

18. The bag closure clip of claim 16 having not more than one clip spring.

* * * * *